United States Patent [19]

Matsuzawa

[11] Patent Number: 4,891,477

[45] Date of Patent: Jan. 2, 1990

[54] KEY SWITCH

[76] Inventor: Isamu Matsuzawa, c/o G.S.K. Sales Company, Limited, 12-2, Sotokanda 2-chome, Chiyoda-ku, Tokyo, Japan

[21] Appl. No.: 201,693

[22] Filed: Jun. 3, 1988

[30] Foreign Application Priority Data

Jun. 18, 1987 [JP] Japan ..... 62-93798[U]

[51] Int. Cl.[4] ..... H01H 27/06

[52] U.S. Cl. ..... 200/61.64; 200/43.08

[58] Field of Search ..... 200/43.08, 61.62, 61.64, 200/61.66, 43.04, 43.07, 43.08, 241

[56] References Cited

U.S. PATENT DOCUMENTS 2,623,959 12/1952 Jarrett ..... 200/61.66
3,160,720 12/1964 Faulkner ..... 200/61.64 X
3,917,919 11/1975 Tahara ..... 200/43.08
4,635,035 1/1987 Ratzabi ..... 200/61.66 X
4,689,451 8/1987 Resh ..... 200/241 X
4,689,456 8/1987 Martin ..... 200/43.08

*Primary Examiner*—J. R. Scott
*Attorney, Agent, or Firm*—Fred Philpitt

[57] ABSTRACT

A key switch that includes both a locking mechanism and a switch mechanism that are separately replaceably coupled together so that either the locking mechanism or the switching mechanism may be individually replaced. The locking mechanism includes a hollow outer cyinder, a hollow inner cylinder rotatably mounted within the interior of the outer cylinder and a notched bolt extending from the rear end portion of the inner cylinder. The switch mechanism includes a case, a cam accommodated therein, and two pairs of contact terminals which are alternately operable by the cam. The cam of the switch mechanism is fitted on the notched bolt of the locking mechanism.

1 Claim, 4 Drawing Sheets

KEY SWITCH

BACKGROUND OF THE INVENTION

1. Field of the Invention

This invention relates to a key switch, which permits the opening and closing of a door or switching of an electric switch of various apparatus to be effected by inserting and turning a key and, more particularly, to a key switch comprising a locking mechanism and a switch mechanism, these mechanisms being separately replaceably coupled together so that the locking mechanism, for instance, may be replaced without need of disconnection of the switch mechanism in case when the locking mechanism is broken or a key is lost.

2. Prior Art

FIGS. 13 and 14 show a prior art key switch. As is shown, this key switch comprises a hollow elongate outer cylinder having opposite side notched surfaces 31*a* and an inner cylinder 33 inserted in the outer cylinder 31 such as to be rotated by 90 degrees by inserting and turning a key 32. The inner cylinder 33 has an integral notched bolt 34 for torque transmission extending from its rear end. A cam 35 is fittedly secured to the notched bolt 34 in the outer cylinder 31. A switch 36 is interlockedly coupled to the cam 35 and is secured to the outer cylinder 31 by caulking tongue members 31B at the rear end of the outer cylinder 31. This key switch is mounted on a door or a mounting plate 37 of an apparatus by tightening a nut 38 screwed on a thread 31*c* of the outer cylinder 31.

As noted above, with this prior art key switch the cam 35 which is coupled to the inner cylinder 33 is rotated by inserting and turning the key 32. With the rotation of the cam 35, the connection of connection terminals 39 of the switch 36 is switched momentarily.

With this prior art key switch, therefore, the switch 36 has to be fabricated and assembled with individual locking mechanism consisting of the outer cylinder 31, inner cylinder 32.

In such key switch in which the switch itself is produced in conformity to the size of the individual locking mechanism and secured by means of caulking to the rear end of the outer cylinder of the locking mechanism, the locking mechanism and switch lack versatility, that is, when for a different lock size the switch has to be changed in conformity to the lock size.

Further, the key switch where the switch is secured by means of caulking as described above, has to be replaced as a whole when the replacement becomes necessary for a maintenance reason such as breakage or the lock or loss of the key. Whenever the key switch is replaced, therefore, the switch has to be re-wired.

SUMMARY OF THE INVENTION

In the light of the above problems( the present invention seeks to provide a key switch, which permits quick replacement of the locking mechanism without need of re-wiring of the switch itself when the replacement becomes necessary due to a maintenance reason such as breakage of the lock or loss of the key.

To attain the above object of the invention, there is provided a key switch, which comprises a locking mechanism including a hollow outer cylinder, a hollow inner cylinder rotatably inserted in the outer cylinder and a notched bolt extending into rear end portions of the outer and inner cylinders and a switch mechanism including a case, a cam accommodated in the case, contact terminals operable by the cam for advancement and retreat and connection terminals to be selectively connected to the contact terminals, the cam in the case of the switch mechanism being fitted on the notched bolt of the locking mechanism.

When a door is to be opened or closed or when an electric switch of an apparatus is to be switched, a key is inserted into a key hole of the locking mechanism and turned by 90 degrees. As a result, the inner cylinder is rotated by 90 degrees to cause a 90-degree rotation of the cam of the switch mechanism fitted on the notched bolt of the locking mechanism.

The rotation of the cam has an effect that a contact that has been in contact with a pair of connection terminals is urged by a cam surface and displaced against a biasing force of a coil spring to be disconnected from these connection terminals while another contact urged by another coil spring is connected to another pair of connection terminals. In this way, the switch of the switch mechanism is switched.

When the replacement of the lock becomes necessary for a maintenance reason such as breakage of the locking mechanism or loss of the key, the locking mechanism is replaced by removing a nut from the notched bolt of the locking mechanism without making any re-wiring of the connection terminals.

In the event of trouble in the switch mechanism, only the switch mechanism is replaced by removing the nut from the notched bolt of the locking mechanism.

DETAILED DESCRIPTION OF THE PREFERRED EMBODIMENT

Figure 1:
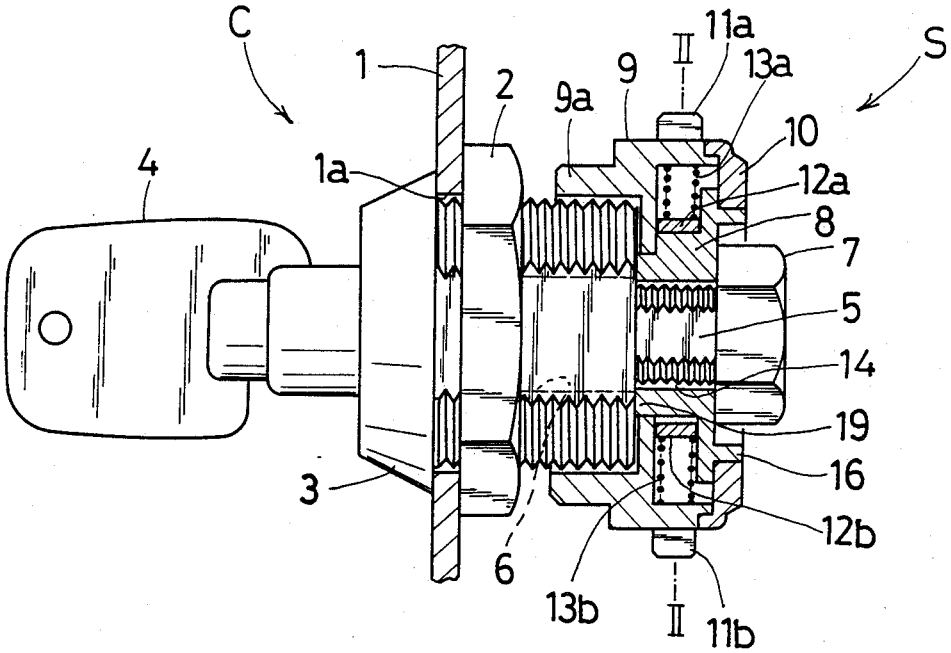
FIG. 1 is a sectional view showing an embodiment of the key switch according to the invention mounted on a plate.
Figure 2:
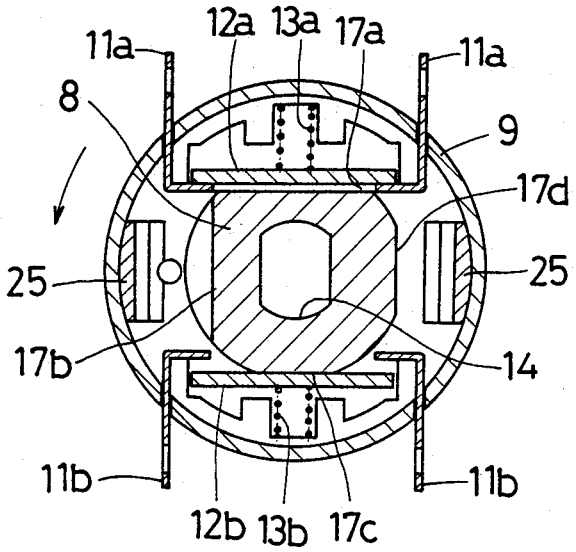
FIG. 2 is a sectional view taken along line II—II in FIG. 1.
Figure 3:
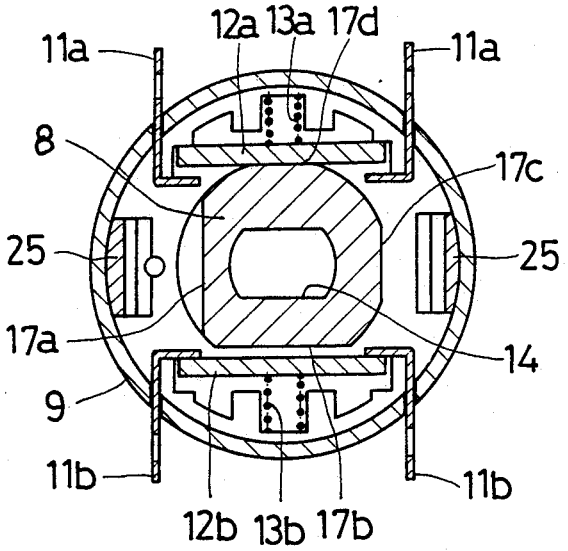
FIG. 3 is a view similar to FIG. 2 but showing a cam after being rotated by 90 degrees.
Figure 4:
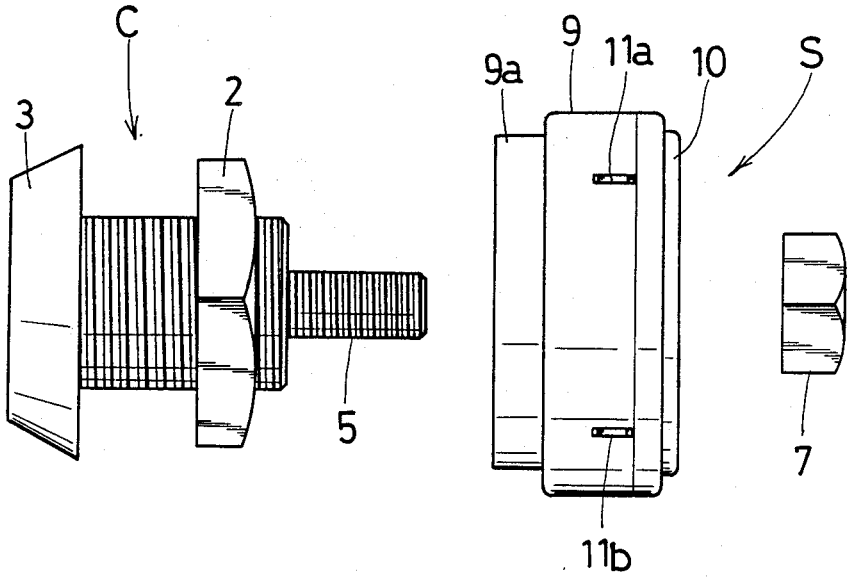
FIG. 4 is a plan view showing a locking mechanism and a switch mechanism before being assembled.

Now, an embodiment of the invention will be described in detail with reference to the drawings.

FIGS. 1 to 12 show an embodiment of the key switch, which comprises a locking mechanism C which is operable by a key 4 and a switch mechanism S operated in an interlocked relation to the locking mechanism C.

The locking mechanism C includes a hollow outer cylinder 3 having a notched outer periphery with a thread and a hollow inner cylinder 6. The outer cylinder 3 is to be mounted in a mounting hole 1*a* of a door or a plate 1 of an apparatus and secured in position by a nut 2. The inner cylinder 6 is inserted in the outer cylinder 3 and rotatable by 90 degrees by inserting and turning the key 4. A notched bolt 5 coupled to the switch mechanism S extends integrally from the rear end of the inner cylinder 6. A nut 7 for retaining the switch mechanism S is screwed on the notched bolt 5.

The switch mechanism S which is in an interlocked relation to the locking mechanism C includes a cam 8 coupled to the notched bolt 5, a case 9 rotatably supporting the cam 8, a cover 10 for preventing detachment of the cam 8, two pairs of L-shaped connection terminals 11*a* and 11*b* penetrating the case 9, plate-like contacts 12*a* and 12*b* and two coil springs 13*a* and 13*b*.

Figure 5:
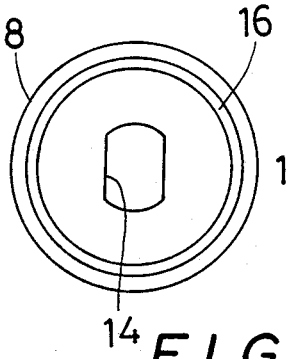
FIG. 5 is a bottom view showing the cam.
Figure 6:
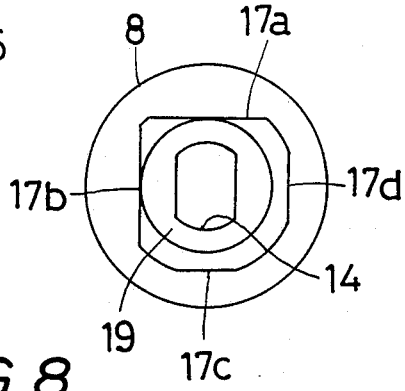
FIG. 6 is a plan view showing the cam.
Figure 7:
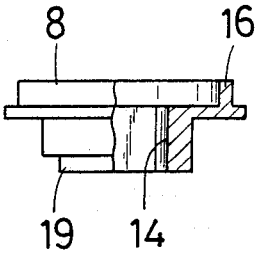
FIG. 7 is a front view, partly broken away, showing the cam.

FIGS. 5 and 7 show in detail the cam 8 as a component of the switch mechanism S. As is shown, the cam 8 has a central non-circular hole 14 which is fitted on the notched bolt 5 of the locking mechanism, a lower annular ridge 16 fitted in a circular hole 15 of the cover 10, large and small notch surfaces 17*a* to 17*d* formed at diametrically opposed positions for urging the contacts 12*a* and 12*b* and an upper ridge 19 fitted in a central support hole 18 of the case 9. The cam 8 thus can be rotated in a central portion of the case 9 in response to an operation of inserting and turning the key 4.

Figure 8:
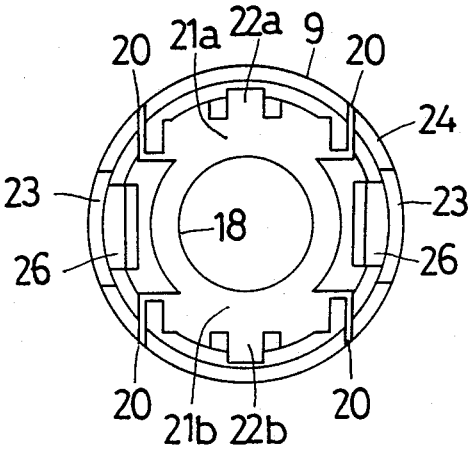
FIG. 8 is a bottom view showing a case.
Figure 9:
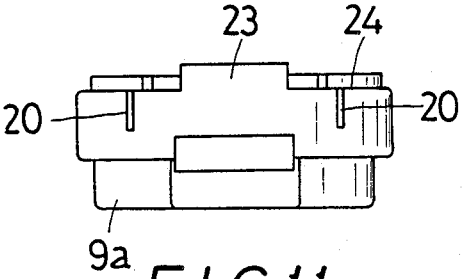
FIG. 9 is a front view showing the case.
Figure 10:
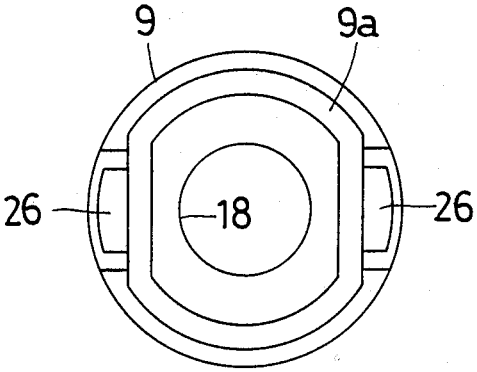
FIG. 10 is a plan view showing the case.

FIGS. 8 to 10 show the case 9. As is shown, the case 9 has its lower surface formed with L-shaped grooves 20, in which stem portions of the connection terminals 11*a* and 11*b* are fitted. It also has recesses 21*a* and 21*b*, in which the contacts 12*a* and 12*b* which are biased by the respective coil springs 13*a* and 13*b* are received. It further has spring accommodation spaces 22*a* and 22*b*, which face the recesses 21*a* and 21*b*, and in which the coil springs 13*a* and 13*b* are received. It still further has diametrically opposed ridges 23 and notches 24 formed in the outer periphery other than the ridges 23. Further, it has a notched cylindrical portion 9*a* fitted on the outer cylinder 3 of the locking mechanism C.

The case 9 further has holes 26 formed on the inner side of the ridges 23 and penetrated by projections 25 of the cover 10.

Figure 11:
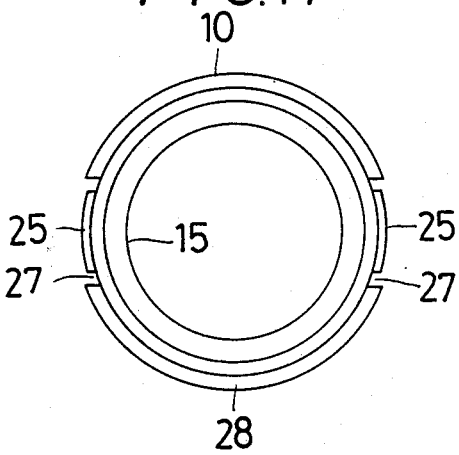
FIG. 11 is a bottom view showing a cover.
Figure 12:
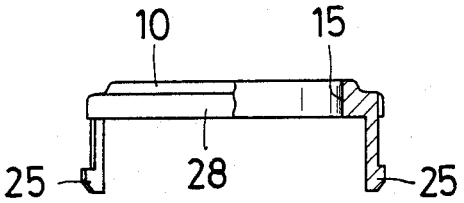
FIG. 12 is a front view, partly broken away, showing the cover.
Figure 13:
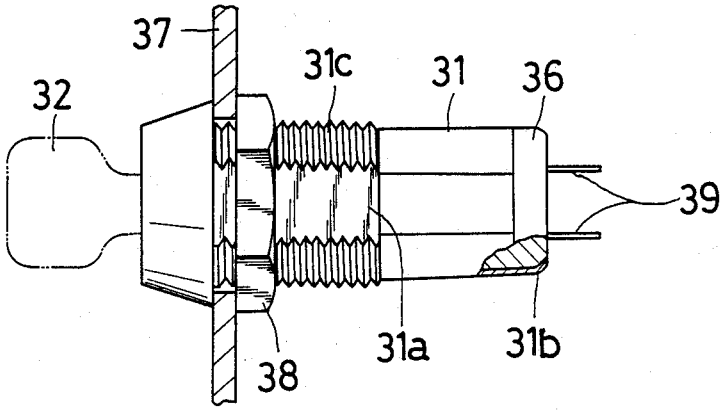
FIG.13 (PRIOR ART)
FIG. 13 is a side view, partly broken away, showing a prior art key switch.
Figure 14:
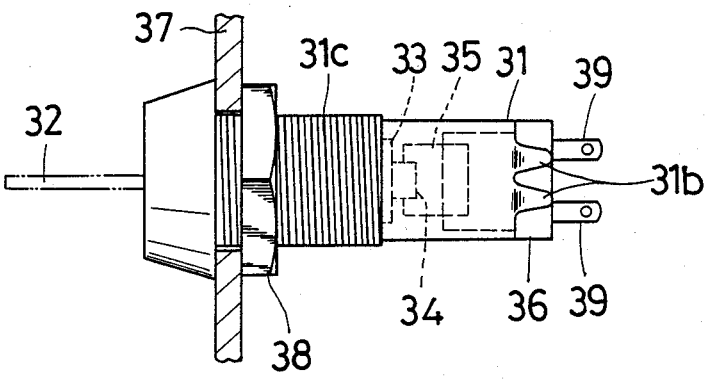
FIG.14 (PRIOR ART)
FIG. 14 is a plan view showing the same prior art key switch.

FIGS. 11 and 12 show the cover 10. As is shown, the cover 10 has the circular hole 15, in which the annular ridge 16 of the cam 8 is fitted. The periphery of the cover 10 has notches 27 and ridges 28 to be engaged with the ridges 23 and notches 24 of the case 9, respectively. The cover 10 further has the projections 25 extending from the inner side of the notches 27.

The connection terminals 11*a* and 11*b* are fitted in the respective grooves 20 of the case 9, and either pair of connection terminals 11*a* or pair of connection terminals 11*b* is brought into contact with the contact 11*a* or 11*b* with the rotation of the cam 8.

To assemble the switch mechanism S consisting of the components as described above, the ridge 19 of the cam 8 is first fitted in the support hole 18 of the case 9, in which the connection terminals 11*a* and 11*b*, contacts 12*a* and 12*b* and coil springs 13*a* and 13*b* are arranged as described above. Then, the ridges 23 of the case 9 are fitted in the notches 27 of the cover 10 while inserting the projections 25 of the cover 10 through the holes 26 of the case 9.

At this time, the ridges 28 of the cover 10 are fitted in the notches 24 of the case 9, and the ridge 16 of the cam 8 is fitted in the circular hole 15 of the cover 10. The cam 8 is thus rotatably supported in the case 9.

Subsequently, the notched cylindrical portion 9*a* of the case 9 of the switch mechanism 5 is fitted on the outer cylinder 3 of the locking mechanism C, the rearwardly extending notched bolt 5 of the locking mechanism C is fitted in the central non-circular hole 14 of the cam 8 in the case 9, and the nut 7 is tightened on the notched bolt 5.

With the key switch as described above, when it becomes necessary to open or close a door or switch an electric switch of an apparatus, the key 4 is inserted into a key hole of the locking mechanism C as shown in FIG. 1 and turned by 90 degrees. As a result, the inner cylinder 6 is also rotated by 90 degrees, and further the cam 8 of the switch mechanism S, fitted on the notched bolt 5 of the inner cylinder 6, is rotated in the same direction, i.e., in the counterclockwise direction from the state shown in FIG. 2 to the state shown in FIG. 3.

With the counterclockwise rotation of the cam 8, the contact 12*a* which has been in contact with the connection terminals 11*a* is urged by the notch surface 17*d* of the cam 8 to be displaced against the biasing force of the coil spring 13*a* and separated from the connection terminals 11*a*, while the contact 12*b* is brought into contact with the connection terminals 11*b* by the biasing force of the coil spring 13*b*. In this way, the switch of the switch mechanism is switched.

If it becomes necessary to replace the lock for such maintenance reason as breakable of the locking mechanism C or loss of the key 4, the locking mechanism C is replaced by removing the nut 7 from the notched bolt 5 of the mechanism C. At this time, the connection terminals 11*a* and 11*b* are not re-wired.

In the event of a damage to or trouble in the switch mechanism C, only the switch mechanism S is removed and replaced by removing the nut 7 from the notched bolt 5 of the locking mechanism C.

As has been described in the foregoing, with the key switch according to the invention the locking mechanism C and switch mechanism S are coupled as separate components to each other by fitting the notched bolt 5 extending from the rear end of the inner cylinder 6 of the locking mechanism C to the non-circular hole 14 of the cam 8 of the switch mechanism S and screwing the nut on the end of the notched bolt. The outer cylinder 3 may have a length which is about one half the length in the case of the prior art, and also no cumbersome caulking operation is required. Thus, the key switch can be reduced in weight and can be manufactured inexpensively in mass production.

Further, the key switch according to the invention has a versatility which is absent in the prior art product. For example, when it becomes necessary to replace the lock due to such maintenance reason as breakage of the locking mechanism or loss of the key, only the replacement of the lock by removing the nut is needed, and no re-wiring of the switch itself is necessary. Thus, the key switch according to the invention is superior in the operability, and it is also economical.

Further, when the switch is damaged or becomes defective, replacement of the switch alone is necessary.

What is claimed is:

1. A key switch comprising:

(A) a lock mechanism that includes (a) a hollow outer cylinder (3), (b) a hollow inner cylinder (6) mounted within the hollow portion of said outer cylinder (3) and being adapted to be rotated with respect to said outer cylinder 3 upon insertion and turning of a key that is operatively connected to said hollow inner cylinder (6), (c) a notched belt (5) extending from the rear end portion of said inner cylinder (6), and (B) a switching mechanism (S) removably engaged with said lock mechanism that includes (a) a case (9) which is removably fitted to said hollow outer cylinder (3), (b) a cam member (8) closely surrounding the exterior surface of said notched bolt (5) and rotatably supported within said case (9) so that it can be rotated from a first position to a second position, and (c) a first pair of contacts consisting of a fixed contacts (11*a*), a bridging contact (12*a*) spring biased toward said first pair of fixed contacts (11*a*), and a second pair of contacts consisting of fixed contacts (11*b*), a bridging contact (12*b*) spring biased toward said second pair of fixed contacts (11*b*), said first and second pairs of contacts being mounted within said case (9) on opposite sides of said cam member (8) so that upon rotation of said cam member to a first position only said first pair of contacts (11*a*, 11*a*), will be in contact with each other, and upon rotation of said cam member (8) to a second position only said second pair of contacts (11*b*, 11*b*) will be in contact with each other, and (C) holding means to hold said lock mechanism and said switching mechanism together in an operative relationship, whereby when a key is inserted and turned the notched bolt (5) will turn, which also causes cam member (8) to turn and thereby move one or the other of said two pairs of contacts and its bridging contact (11*a*, 12*a* or 11*b*, 12*b*) into contact with each other, and the other pair of said contacts and bridging contact out of contact with each other, and whereby either said lock mechanism or said switching mechanism may be individually replaced by simply releasing said holding means and separating the two mechanisms.

* * * * *